US009929514B2

(12) United States Patent
Kato et al.

(10) Patent No.: US 9,929,514 B2
(45) Date of Patent: Mar. 27, 2018

(54) FIXING STRUCTURE OF SHIELD CONNECTOR

(71) Applicant: Yazaki Corporation, Minato-ku, Tokyo (JP)

(72) Inventors: Hajime Kato, Kakegawa (JP); Haruhiko Yokoyama, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/444,659

(22) Filed: Feb. 28, 2017

(65) Prior Publication Data

US 2017/0256893 A1 Sep. 7, 2017

(30) Foreign Application Priority Data

Mar. 1, 2016 (JP) ..... 2016-039160

(51) Int. Cl.
*H01R 13/6593* (2011.01)
*H01R 13/512* (2006.01)

(52) U.S. Cl.
CPC ..... *H01R 13/6593* (2013.01); *H01R 13/512* (2013.01)

(58) Field of Classification Search
CPC ..... H01R 13/6593; H01R 13/512
USPC ..... 439/607.55
See application file for complete search history.

(56) References Cited

U.S. PATENT DOCUMENTS 9,559,467 B1 * 1/2017 Khorrami ..... H01R 13/62933
9,620,899 B2 * 4/2017 Kato ..... H01R 13/631
9,722,361 B2 * 8/2017 Tanaka ..... H01R 13/6581
2008/0268707 A1 * 10/2008 Wu ..... H01R 23/6873 439/607.01
2009/0126985 A1 * 5/2009 Aoki ..... H02G 3/0683 174/377
2012/0208404 A1 * 8/2012 Matsumoto ..... H01R 13/447 439/661
2014/0051286 A1 * 2/2014 Itsuki ..... H01R 13/533 439/587
2014/0120767 A1 * 5/2014 Itsuki ..... H01R 13/5208 439/587
2016/0056584 A1 * 2/2016 Nakai ..... H01R 13/506 439/607.01
2016/0240982 A1 * 8/2016 Ohkubo ..... H01R 9/032
(Continued)

FOREIGN PATENT DOCUMENTS

JP 201486152 A 5/2014

*Primary Examiner* — Alexander Gilman
(74) *Attorney, Agent, or Firm* — Sughrue Mion, PLLC

(57) ABSTRACT

A fixing structure of a shield connector includes a housing, a shield shell, a protector and a protector engaged part on an electric wire leading-out part side of the protector. In the housing, an electric wire is configured to be led out from one end side in a direction intersecting a fitting direction in a state that the other end side is fitted to a device side connector. The shield shell is configured to be electrically connected and fixed to a shield case of the device so as to cover the housing. The protector is attached to the electric wire leading-out part side in the shield shell so as to cover the electric wire. The protector engaged part is configured to be engaged with and disengaged from a protector engaging part on the shield case in the same direction as the fitting direction.

9 Claims, 11 Drawing Sheets

(56) References Cited

U.S. PATENT DOCUMENTS

| | | | | |
|---|---|---|---|---|
| 2016/0268733 | A1* | 9/2016 | Kato | H01R 13/631 |
| 2016/0294110 | A1* | 10/2016 | Motohashi | H01R 13/533 |

* cited by examiner

FIXING STRUCTURE OF SHIELD CONNECTOR

CROSS REFERENCE TO RELATED APPLICATIONS

This application claims priority from Japanese Patent Application No. 2016-039160 filed on Mar. 1, 2016, the entire contents of which are incorporated herein by reference.

BACKGROUND OF THE INVENTION

Field of the Invention

The present invention relates to a fixing structure of a shield connector.

Description of Related Art

On a vehicle such as a motor vehicle, many devices to be mounted for a vehicle such as a motor are mounted. Accordingly, an influence due to electromagnetic waves generated from these devices cannot be neglected. Further, an influence due to electromagnetic waves generated from an electric wire connection part for a large electric current and high voltage also causes a problem. Although countermeasures are different depending on sources of generation of the electromagnetic waves or kinds of the electromagnetic waves, the devices to be mounted for the vehicle or connection components for a harness are protected from a trouble caused by the electronic waves by using a method such as an electromagnetic shield method.

As for an electric wire which supplies a power to the devices to be mounted for the vehicle such as the motor or transmits or receives a signal, an electric wire in which a periphery of a core wire is shielded as required is widely used. Especially, since the electric wire whose diameter is progressively decreased in order to reduce its weight is liable to receive the influence due to the electronic waves, a shield electric wire is used.

The shield electric wire has a structure that an outside of the core wire insulated and coated with an inner film is covered with a braided part, and further, an outside thereof is insulated and coated with a sheath in order to interrupt an electric noise such as the electromagnetic waves or a static electricity.

A high voltage connector (a shield connector) which grounds or connects the braided part of such a shield electric wire to a shield case (a metal case or the like) of the above-described devices (for instance, a PCU (Power Control Unit) as an electric power control unit) includes a shield shell which connects a plurality of electric wires together and has an electric conductivity to protect the shield electric wires and terminals connected to the core wires of the shield electric wires under a shielded state (patent literature 1: JP-A-2014-86152).

One example of a fixing structure of the above-described shield connector will be described below by referring to FIG. 11.

FIG. 11 is a sectional view of main parts showing a fixing structure of a usual shield connector.

The shield connector 501 includes a housing 502 to which an electric wire C is introduced from a lower side, a shield shell 505 having an upper shell 503 and a lower shell 504 which cover the housing 502, a fastening part 507 provided in an upper end and front edge of the shield shell 505 and fastened by a fastening bolt BT from an upper side to be electrically connected and fixed to a shield case 506 and an auxiliary fastening part 508 provided in a lower side of the shield shell 505 and fastened by the fastening bolt BT from the upper side to be electrically connected and fixed to the shield case 506.

[Patent Literature 1] JP-A-2014-86152

According to a related art, a shield connector 501 has a structure that a fastening part 507 of a upper shell 503 and a auxiliary fastening part 508 of a lower shell 504 as a separate members are fastened to a shield case 506 by a fastening bolt BT from upper and lower parts to prevent the shied connector 501 from shaking. Accordingly, depending on unevenness in a dimension of a space between the fastening part 507 and the auxiliary fastening part 508, a stress during a fastening operation of the bolt is applied to the fastening bolt 507 and the auxiliary fastening part 508 before a vibration is applied thereto, the shield shell 505 may be possibly broken. As for a countermeasure to prevent the shield shell 505 from being broken, a change of a material, for instance, strength of a material is increased, or a countermeasure for a configuration is necessary. Thus, a cost is increased.

SUMMARY

One or more embodiments provide a fixing structure of a shield connector which can improve a fixing strength of a shield shell without increasing a cost.

In accordance with one or more embodiments, a fixing structure of a shield connector according to the present invention is characterized by structures of below-described (1) to (3).

(1) A fixing structure of a shield connector includes a housing, a shield shell, a protector, and a protector engaged part on an electric wire leading-out part side of the protector. In the housing, an electric wire is configured to be led out from one end side in a direction intersecting a fitting direction in a state that the other end side is fitted to a device side connector. The shield shell is configured to be electrically connected and fixed to a shield case of the device so as to cover the housing. The protector is attached to the electric wire leading-out part side in the shield shell so as to cover the electric wire led out from the housing. The protector engaged part is configured to be engaged with and disengaged from a protector engaging part on the shield case in the same direction as the fitting direction of the housing.

In the fixing structure of the shield connector having the structure of the above-described (1), in the fitting operation of the shield connector, the housing is fitted to the device side connector, and at the same time, the protector engaged part on the electric wire leading-out part side of the protector is engaged with the protector engaging part of the shield case.

Thus, in the electric wires led out from the housing, a vibration is suppressed by the electric wire leading-out part side of the protector engaged with the shield case. Further, even when the electric wires guided out from the electric leading-out part side of the protector are bent, an influence of bending can be allowed to be hardly applied to, for instance, a rubber plug provided in the electric-wire leading-out part of the housing.

Further, since the engaged part for the protector is engaged with the protector engaging part of the shield case when the shield connector is fitted to the device side connector, a large fixing operation space as in the usual structure in which the electric wire led out from the housing is fixed to a neighboring fixing part (a vehicle body or the like) by a clamp member in order to prevent the vibration can be made to be unnecessary.

(2) The fixing structure of a shield connector may further include protector fixed parts on a shield shell attaching part side on the protector. The protector fixed parts are configured to fix the protector to protector fixing parts on the shield case.

In the fixing structure of the shield connector having the structure of the above-described structure (2), since the engaged part for the protector in the electric wire leading-out part side is engaged with the protector engaging part and the protector fixed parts in the attaching part side to the shield shell are fixed to the protector fixing parts, the protector can be strongly fixed to the shield case.

Since the protector fixed parts are fixed to the protector fixing parts in such a way, a situation does not occur that the shield case and the fixing parts of the shield shell receive the influence of the bending or vibration of the led out electric wires to apply the stress only to the fixing parts of the shield shell.

(3) The fixing structure of a shield connector may further include a shell fixed part on the shield shell and fastening bolts. The shell fixed part is configured to fix the shield shell to shield shell fixing parts on the shield case. The fastening bolts are configured to pass through the shell fixed part so as to fix the shield shell fixing parts, the protector fixing parts, and the protector fixed parts in a direction intersecting the fitting direction of the housing, and to fasten them together.

In the fixing structure of the shield connector having the structure of the above-described (3), since the shell fixed part and the protector fixed parts are fastened together by the fastening bolts, both the shell fixed part and the protector fixed parts can be fixed to the shield case at one time. Further, even when a sufficient fastening operation space is not provided in the rear surface side of the housing, the fastening bolts can pass through the shell fixed part and the shield shell fixing parts, and the protector fixing parts and the protector fixed parts in the direction intersecting the fitting direction of the housing and easily fasten them together, the shield connector can be easily attached to the shield case.

Further, since the engaged part for the protector is engaged with the protector engaging part so that the protector is positioned to the shield case, the bolt through holes of the protector fixed parts are easily positioned to the bolt through holes of the protector fixing parts.

Advantages of the Invention

According to one or more embodiments, the fixing structure of the shield connector can be provided which can improve a fixing strength of the shield shell without increasing a cost.

As described above, the present invention is briefly explained. Further, when a mode for carrying out the invention (refer it to as an "exemplary embodiment", hereinafter) which will be described below is read by referring to the attached drawings, a detail of the present invention will be more clarified.

DETAILED DESCRIPTION

Figure 1:
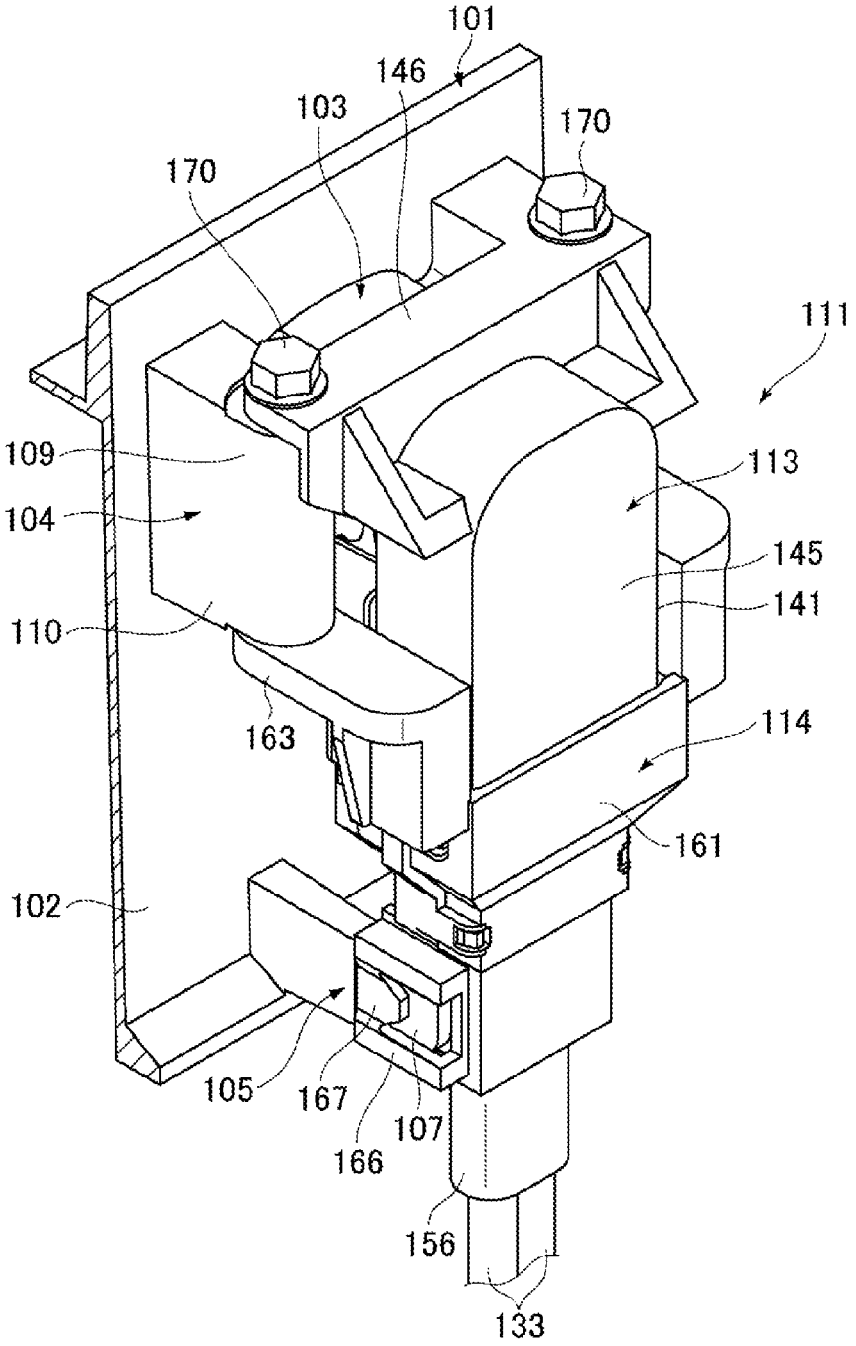
FIG. 1 is a perspective view showing a shield connector fixed to a shield case in order to explain a fixing structure of the shield connector according to one exemplary embodiment.

Exemplary embodiments will be described below by referring to the drawings.

Figure 2:
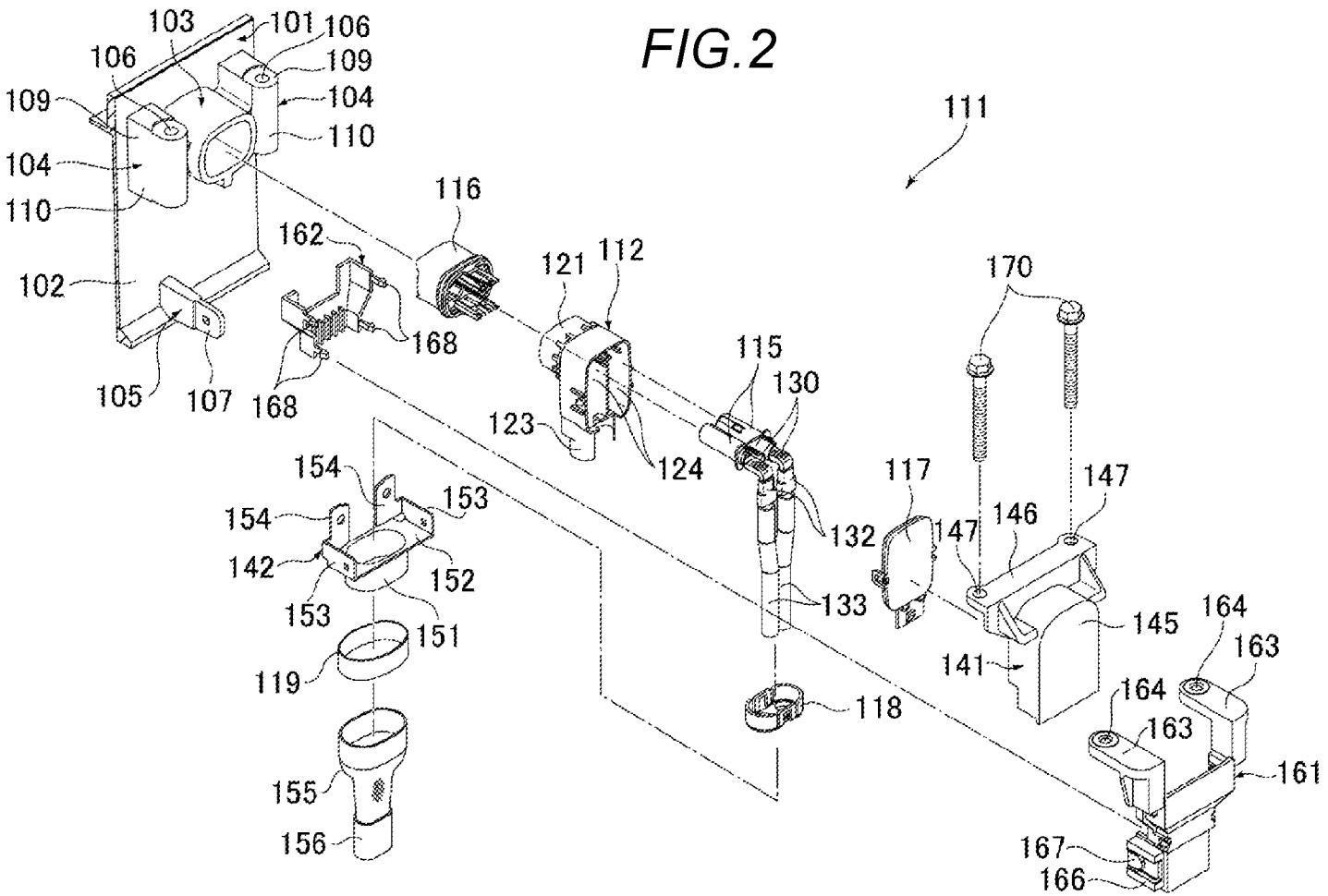
FIG. 2 is an exploded perspective view of the shield connector shown in FIG. 1.
Figure 3:
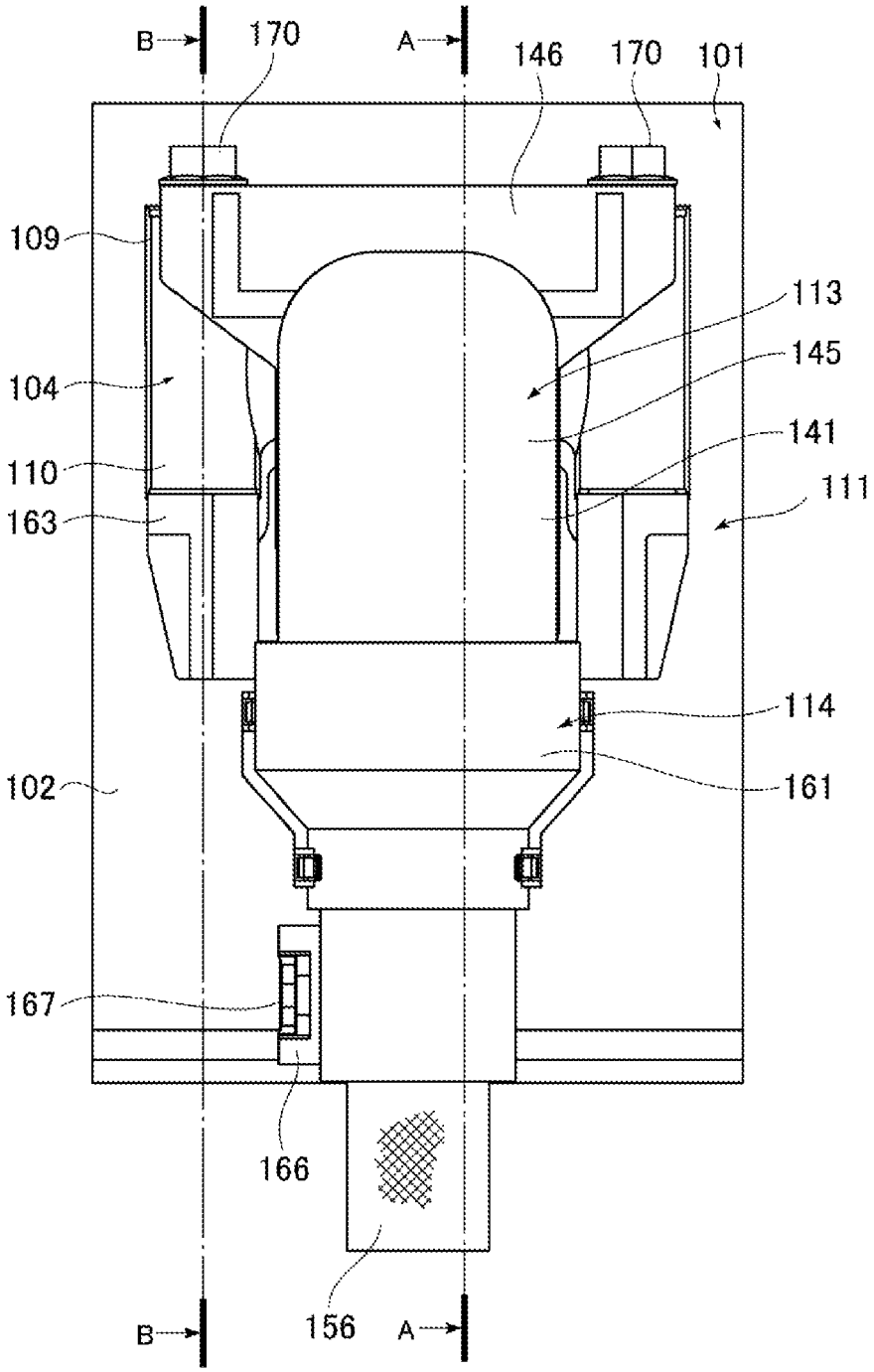
FIG. 3 is a rear view of the shield connector shown in FIG. 1.
Figure 4:
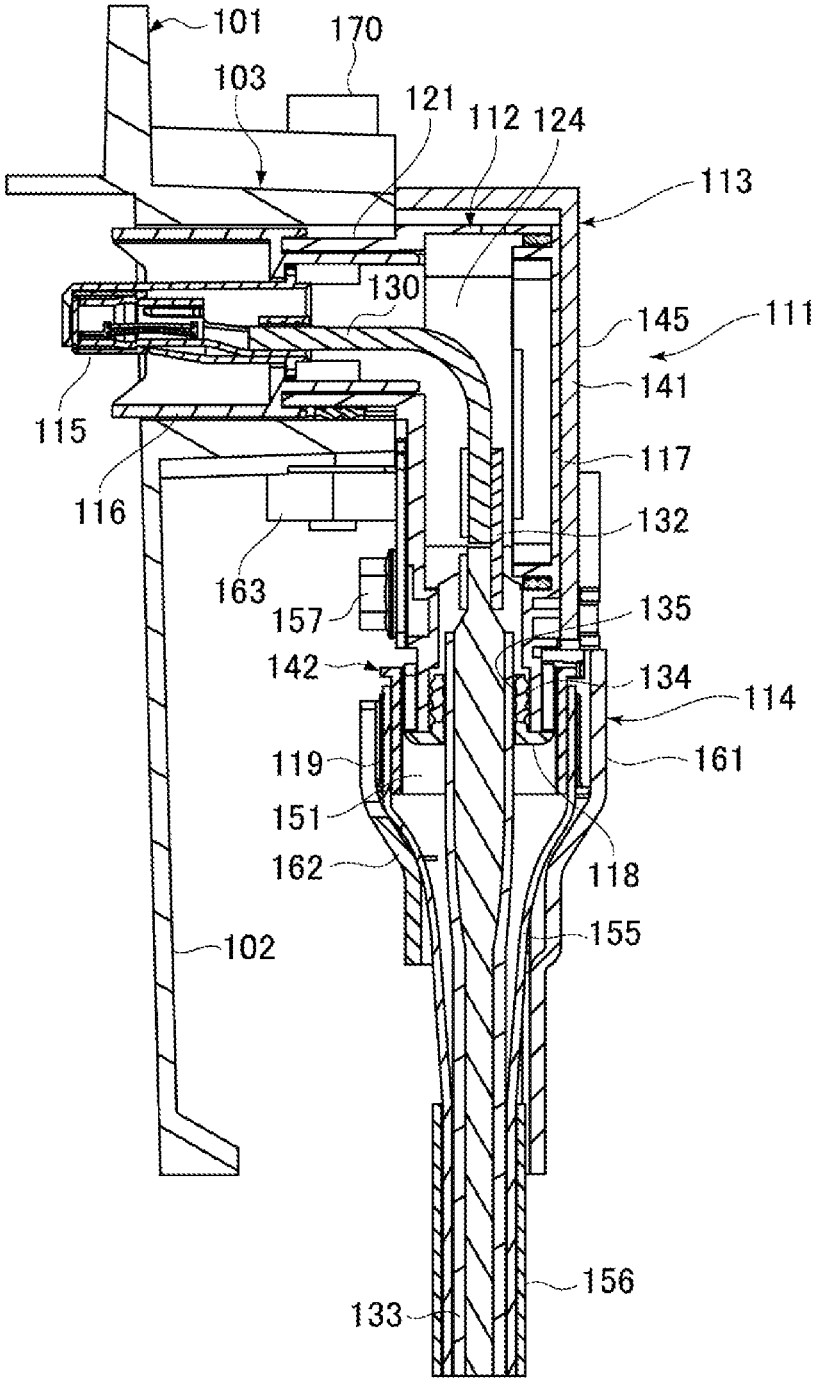
FIG. 4 is a sectional view taken along a line A-A in FIG. 3.
Figure 5:
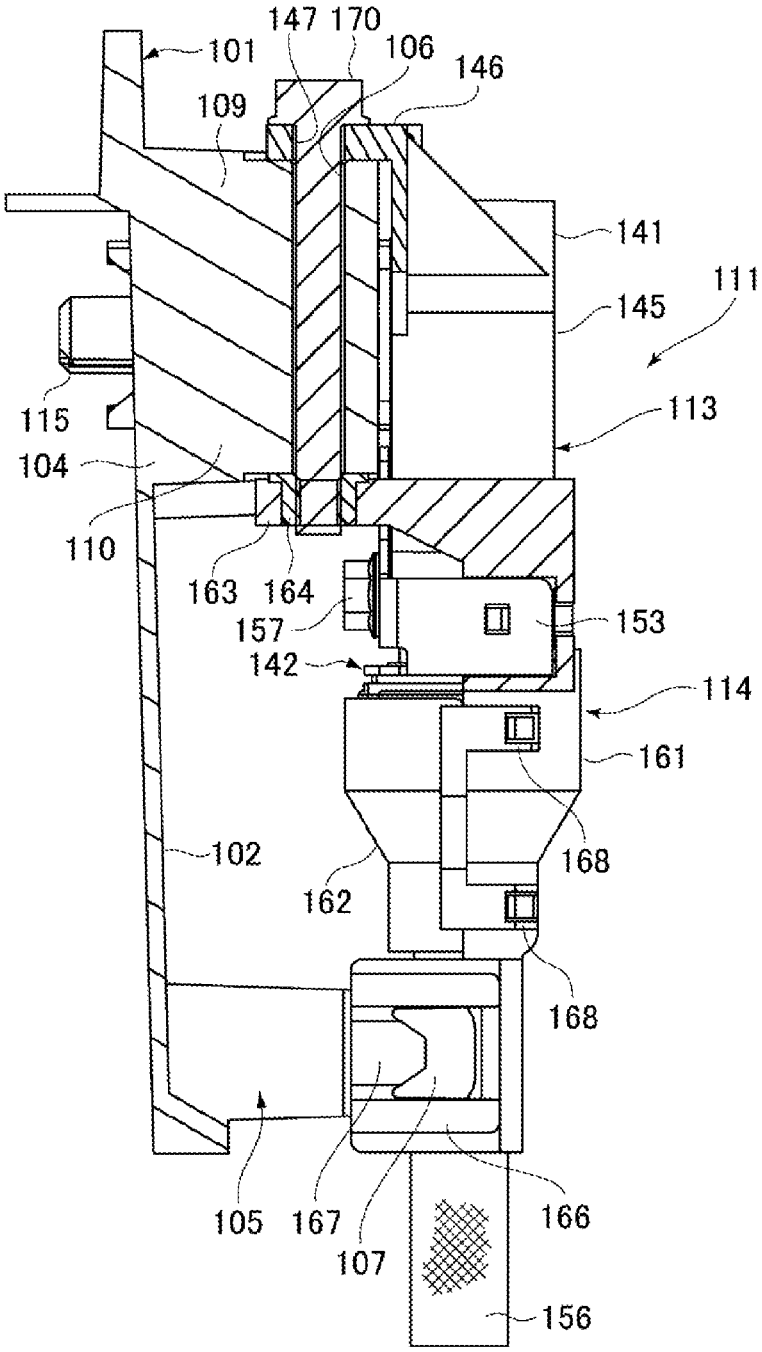
FIG. 5 is a sectional view taken along a line B-B in FIG. 3.

FIG. 1 is a perspective view showing a shield connector fixed to a shield case in order to explain a fixing structure of the shield connector according to one exemplary embodiment of the present invention. FIG. 2 is an exploded perspective view of the shield connector shown in FIG. 1. FIG. 3 is a rear view of the shield connector shown in FIG. 1. FIG. 4 is a sectional view taken along a line A-A in FIG. 3. FIG. 5 is a sectional view taken along a line B-B in FIG. 3.

As shown in FIG. 1, a fixing structure of a shield connector 111 according to one exemplary embodiment of the present invention is a fixing structure which fits and fixes a housing 112 of the shield connector 111 to a device side connector (an illustration is omitted) provided in a shield case 101.

As shown in FIG. 2 to FIG. 5, the shield connector 111 of the present exemplary embodiment includes the housing 112, a shield shell 113 and a protector 114 as a main structure.

The shield case 101 is formed with an electrically conductive metal material, for instance, a metal case of an inverter or a motor mounted on an electric motor vehicle or a hybrid vehicle. Further, the shield case 101 may be a metal case of a PCU as an electric power control unit.

In the shield case 101, are provided a tubular fitting tube part 103 protruding on a connector attaching surface 102, connector fixing blocks 104 provided in both sides of the fitting tube part 103 and a protector engaging part 105 provided at a position spaced downward from the fitting tube part 103 and the connector fixing blocks 104 in the drawing. In the connector fixing blocks 104, bolt through holes 106 which pass through in a vertical direction are provided. The connector fixing block 104 has a shield shell fixing part 109 in its upper end side and a protector fixing part 110 in its lower end side. Further, the protector engaging part 105 is formed as a bracket 107 whose end is formed in the shape of a flat plate.

The housing 112 according to the present exemplary embodiment is formed with an insulating synthetic resin. The housing 112 has a fitting part 121 protruding in one end side thereof. To the fitting part 121, a front holder 116 is attached. Further, in the other end side of the housing 112, an electric wire leading-out part 123 is provided which is extended in a direction intersecting (downward in FIG. 2) a protruding direction of the fitting part 121. To the electric wire leading-out part 123, end parts of electric wires 133 to which terminals 132 are connected are guided. The electric wire 133 includes an electrically conductive core wire and an insulating coating part with which the core wire is coated. The core wire of the electric wire 133 is electrically connected to the terminal 132.

Further, in the housing 112, one pair of terminal accommodation chambers 124 are formed in a rear surface side thereof. The terminal accommodation chambers 124 are closed by a cover 117 attached from the rear surface of the housing 112. In the terminal accommodation chambers 124 respectively, connection terminals 115 are accommodated. The connection terminals 115 are connected to the terminals 132 through braided wires 130. Namely, since the terminals 132 of the electric wires 133 are connected to the connection terminals 115 through the flexible braided wires 130, a vibration of the electric wires 133 are absorbed by the braided wires 130, so that the vibration is hardly transmitted to the connection terminal 115 side.

As shown in FIG. 4, to a part near the end part of the electric wire 133, a rubber plug 134 is attached. The rubber plug 134 is fitted to the electric wire leading-out part 123. The rubber plug 134 is formed with an elastic material such as rubber. The rubber plug 134 has a hole part 135 and the electric wire 133 is inserted into the hole part 135. An outer periphery of the rubber plug 134 comes into close contact with an inner wall surface of the electric wire leading-out part 123 of the housing 112. Thus, the rubber plug 134 seals apart between the housing 112 and the electric wire 133 under a water-proofed state. Further, to the electric wire leading-out part 123 of the housing 112, a rear holder 118 is attached. The electric wire leading-out part 123 is closed by the rear holder 118. The rear holder 118 is attached to the electric wire leading-out part 123 of the housing 112, so that the electric wire 133 is restrained from being bent. Further, the rear holder 118 restrains the rubber plug 134 from slipping out or collapsing in the electric wire leading-out part 123.

The shield shell 113 according to the present exemplary embodiment is formed with an electrically conductive metal material. The shield shell 113 includes an upper shell 141 and a lower shell 142. The upper shell 141 includes a housing accommodation part 145 and a shell fixed part 146 which is provided in an upper part of the housing accommodation part 145. The housing accommodation part 145 is formed in the shape of a box which covers an upper surface, both side surfaces and a rear surface of the housing 112 and attached to the housing 112 from its rear surface side. The shell fixed part 146 protrudes in an attaching direction to the housing 112 and attaching holes 147 are formed in the vicinity of both ends thereof.

The lower shell 142 includes a tubular part 151, a plate shaped part 152 provided in one opening end side of the tubular part 151, side plate parts 153 vertically provided in both side ends of the plate shaped part 152 and end plate parts 154 respectively provided in one side edges of the side plate parts 153. The lower shell 142 is attached to the housing 112 from the electric wire leading-out part 123 side. The electric wire leading-out part 123 is fitted to the tubular part 151 and fixed by screws 157.

In the lower shell 142, the tubular part 151 is covered with an end part of a braided wire 155 which covers peripheries of a plurality of electric wires 133 and a shield ring 119 is caulked on an outer peripheral side thereof. Thus, the braided wire 155 is electrically connected to the lower shell 142. On an outer periphery of the braided wire 155 which covers the electric wires 133, a coating 156 is provided.

When the upper shell 141 and the lower shell 142 are attached to the housing 112, the side plate parts 153 of the lower shell 142 abut on the side surfaces of the housing accommodation part 145 of the upper shell 141. Thus, the upper shell 141 is electrically conducted to the lower shell 142 to each other.

The protector 114 according to the present exemplary embodiment is formed with an insulating synthetic resin and includes a rear protector 161 and a front protector 162. The rear protector 161 is attached to a rear surface side of the electric wire leading-out part 123 in the housing 112 to which the shield shell 113 is attached. Thus, the rear surface side of the electric wire leading-out part 123 of the housing 112 to which the shield shell 113 is attached is covered with the rear protector 161. The rear protector 161 has protector fixed parts 163 on both side parts thereof. The protector fixed parts 163 are extended upward and upper end parts (upper parts in FIG. 2) as a shield shell attaching part side to the shield shell 113 are allowed to protrude forward. In the protector fixed parts 163, nut members 164 are embedded.

Further, the protector 114 has an engaged part 166 for the protector. The engaged part 166 for the protector is formed in one side part of the rear protector 161 forming the protector 114 in the electric wire leading-out part 123 side. The engaged part 166 for the protector has a lock part 167. The lock part 167 is engaged with the bracket 107 of the protector engaging part 105 of the shield case 101. Namely, the engaged part 166 for the protector can be engaged with and disengaged from the protector engaging part 105 of the shield case 101 in the same direction as a fitting direction of the fitting part 121 of the housing 112 to the fitting tube part 103.

The front protector 162 is attached to a front surface side of the electric wire leading-out part 123 of the housing 112 to which the shield shell 113 is attached. Thus, the electric wire leading-out part 123 of the housing 112 to which the shield shell 113 is attached is covered with the front protector 162 in its front surface side. A plurality of engaging pawls 168 are formed in the front protector 162. The engaging pawls 168 are engaged with the rear protector 161. Thus, the rear protector 161 and the front protector 162 are fixed to each other and attached to the electric wire leading-out part 123 of the housing 112 to which the shield shell 113 is attached.

In order to connect the shield connector 111 to the device side connector, the fitting part 121 provided with the front holder 116 in the housing 112 is allowed to come close to the shield case 101 side to fit the fitting part 121 to the fitting tube part 103 of the device side connector. Thus, in the shield connector 111, the connection terminals 115 thereof are electrically connected to connection terminals (an illustration is omitted) of the device side connector. Then, in a state that the fitting part 121 in the one end side of the housing 112 is fitted to the device side connector, the electric wires 133 led out from the electric wire leading-out part 123 in the other end side are led out in a lower direction intersecting the fitting direction to the device side connector.

Further, substantially at the same time when the fitting part 121 of the housing 112 of the shield connector 111 is fitted to the fitting tube part 103 of the device side connector, the bracket 107 of the protector engaging part 105 provided in the shield case 101 is inserted into the engaged part 166 for the protector provided in the electric wire leading-out part 123 side of the protector 114 and the lock part 167 of the engaged part 166 for the protector is engaged with the bracket 107. Thus, the electric wire leading-out part 123 side of the protector 114 is supported by the shield case 101.

Under this state, the shell fixed part 146 of the upper shell 141 which forms the shield shell 113 is arranged on the shield shell fixing parts 109 of the connector fixing blocks 104 and the protector fixed parts 163 of the rear protector 161 which forms the protector 114 are arranged under the protector fixing parts 110 of the connector fixing blocks 104. Then, the attaching holes 147 of the shell fixed part 146 are allowed to communicate with the bolt through holes 106 of the connector fixing blocks 104 and the nut members 164 of the protector fixed parts 163 are arranged at positions facing the bolt through holes 106 of the connector fixing blocks 104.

Thus, fastening bolts 170 are inserted from an upper part to the attaching holes 147 and the bolt through holes 106 which communicate with each other, screwed and fastened to the nut members 164 of the protector fixed parts 163. At this time, since the protector engaged part 166 is engaged with the protector engaging part 105 so that the protector 114 is positioned to the shield case 101, the fastening bolts 170 inserted into the attaching holes 147 and the bolt through holes 106 can be smoothly and easily screwed to the nut members 164 of the protector fixed parts 163.

Then, when the fastening bolts 170 are screwed and fastened to the nut members 164 of the protector fixed parts 163, the shell fixed part 146, the shield shell fixing parts 109, the protector fixing parts 110 and the protector fixed parts 163 are fastened together by the fastening bolts 170 passing through in a direction (a direction directed to a lower part from an upper part in FIG. 5) which intersects the fitting direction of the housing 112. Thus, the shell fixed part 146 is fixed to the shield shell fixing parts 109 of the connector fixing blocks 104 and the protector fixed parts 163 are fixed to the protector fixing parts 110 of the connector fixing blocks 104. Further, the shield shell 113 to which the braided wire 155 covering the electric wires 133 is electrically connected is electrically connected to the shield case 101. Thus, the shield shell 113 forms a shield circuit, so that a structure which shields noise is obtained.

As described above, in the fixing structure of the shield connector 111 according to the present exemplary embodiment, during a fitting operation of the shield connector 111, when the housing 112 is fitted to the device side connector, the protector engaged part 166 in the electric wire leading-out part 123 side of the protector 114 is engaged with the protector engaging part 105 of the shield case 101. Then, in a state that the engaged part 166 for the protector is engaged with the protector engaging part 105, the shield shell 113 and the protector 114 can be attached and fixed to the shield case 101 by the fastening bolts 170. Accordingly, even when a sufficient operation space is not provided in a rear surface side (a right side in FIG. 5) of the shield connector 111, the shield connector 111 can be easily attached to the shield case.

Thus, since the electric wires 133 led out from the housing 112 are held by the electric wire leading-out part 123 side of the protector 114 engaged with the shield case 101, a vibration can be suppressed. Further, even when the electric wires 133 led out from the electric wire leading-out part 123 side of the protector 114 are pulled and bent, an influence of bending can be allowed to be hardly applied to the rubber plug 134 of the electric wire leading-out part 123 of the housing 112.

Further, since the engaged part 166 for the protector is engaged with the protector engaging part 105 of the shield case 101 at the same time when the shield connector 111 is fitted to the device side connector, a large operation space required to prevent the vibration as in the usual structure in which the electric wires 133 led out from the housing 112 are fixed to a neighboring fixing part (a vehicle body) by a clamp member or the like can be made to be unnecessary.

Further, the fixing structure of the shield connector 111 according to the present exemplary embodiment includes the protector fixing parts 110 provided in the shield case 101 and the protector fixed parts 163 provided in the attaching part side of the protector 114 to the shield shell 113 in order to fix the protector 114 to the protector fixing parts 110. Thus, when the engaged part 166 for the protector in the electric wire leading-out part 123 side is engaged with the protector engaging part 105 and the protector fixed parts 163 are fixed to the protector fixing parts 110, the protector 114 is strongly fixed to the shield case 101.

Since the protector fixed parts 163 are fixed to the protector fixing parts 110 as described above, such a situation does not occur that the shell fixed part 146 as a fixing part of the shield case 101 and the shield shell 113 receives an influence of the bending or vibration of the led-out electric wires 133 and a stress is applied only to the shell fixed part 146.

Further, according to the present exemplary embodiment, since the shell fixed part 146 and the protector fixed parts 163 are fastened together by the fastening bolts 170, both the shell fixed part 146 and the protector fixed parts can be fixed to the shield case 101 at one time. Further, even when the sufficient fastening operation space is not provided in the rear surface side (the right side in FIG. 5) of the housing 112, the fastening bolts 170 passes through the shell fixed part 146 and the shield shell fixing parts 109 and the protector fixing parts 110 and the protector fixed parts 163 in the direction (the direction directed to the lower part from the upper part in FIG. 5) intersecting the fitting direction of the housing 112, so that the fastening bolts 170 can easily fasten, attach and fix these members together.

Further, in the protector 114, since the engaged part 166 for the protector is engaged with the protector engaging part 105 and positioned to the shield case 101, the protector fixed parts 163 can be easily positioned to the bolt through holes 106 of the protector fixing parts 110.

In the above-described exemplary embodiment, the protector engaging part 105 is formed as the protruding piece shaped bracket 107 and the engaged part 166 for the protector is formed as the lock part 167 engaged with the bracket 107. However, an engagement structure that the protector engaging part 105 is engaged with the engaged part 166 for the protector is not limited to the above-described structure. For instance, the protector engaging part 105 may be formed as an engaging hole and the engaged part 166 for the protector may be formed as an engaging protrusion engaged with the engaging hole.

Further, the electric wires 133 led out from the electric wire leading-out part 123 side of the protector 114 may be tightly fastened and fixed to the electric wire leading-out part 123 side of the protector 114 by a binding band. In such a way, the influence of the vibration or bending of the electric wires 133 can be assuredly prevented from being applied to the electric wire leading-out part 123 of the housing 112.

Further, a specific fixing method of the protector fixing parts 110 and the protector fixed parts 163 is not limited to the method for fastening the fastening bolts 170 to the nut members 164, and various fixing methods may be adopted.

Further, the above-described exemplary embodiment exemplifies an example having the connector fixing blocks 104 provided with block structures in which the shield shell fixing parts 109 are formed integrally with the protector fixing parts 110. However, a block structure may be used that a shield shell fixing part and a protector fixing part are provided as separate members respectively having concentric bolt through holes 106 through which fastening bolts 170 pass.

Accordingly, the fixing structure of the shield connector 111 can be provided which can improve the fixing strength of the shield shell 113 without increasing the cost.

The present invention is not limited to the above-described exemplary embodiment and may be suitably modified and improved. In addition thereto, materials, forms, dimensions, numbers, arranged positions or the like of component elements of the above-described exemplary embodiment may be arbitrarily used as long as the present invention can be achieved.

Now, features of the above-described embodiments of the fixing structure of the shield connector according to the present invention will be respectively briefly described below in the following [1] to [3].

[1] A fixing structure of a shield connector comprising:

a housing;

a shield shell;

a protector; and a protector engaged part on an electric wire leading-out part side of the protector, wherein in the housing, an electric wire is configured to be led out from one end side in a direction intersecting a fitting direction in a state that the other end side is fitted to a device side connector, wherein the shield shell is configured to be electrically connected and fixed to a shield case of the device so as to cover the housing, wherein the protector is attached to the electric wire leading-out part side in the shield shell so as to cover the electric wire led out from the housing, and wherein the protector engaged part is configured to be engaged with and disengaged from a protector engaging part on the shield case in the same direction as the fitting direction of the housing.

[2] The fixing structure of a shield connector according to the above-described [1], further comprising:

a protector fixed part on a shield shell attaching part side on the protector, wherein the protector fixed part is configured to fix the protector to a protector fixing part on the shield case.

[3] The fixing structure of a shield connector according to the above-described [2], further comprising:

a shell fixed part on the shield shell; and a fastening bolt, wherein the shell fixed part is configured to fix the shield shell to a shield shell fixing part on the shield case, and wherein the fastening bolt is configured to pass through the shell fixed part, the shield shell fixing part, the protector fixing part, and the protector fixed part in a direction intersecting the fitting direction of the housing so as to fasten the shell fixed part, the shield shell fixing part, the protector fixing part, and the protector fixed part together.

Now, a fixing structure of a shield connector according to a reference example will be described below.

Figure 6:
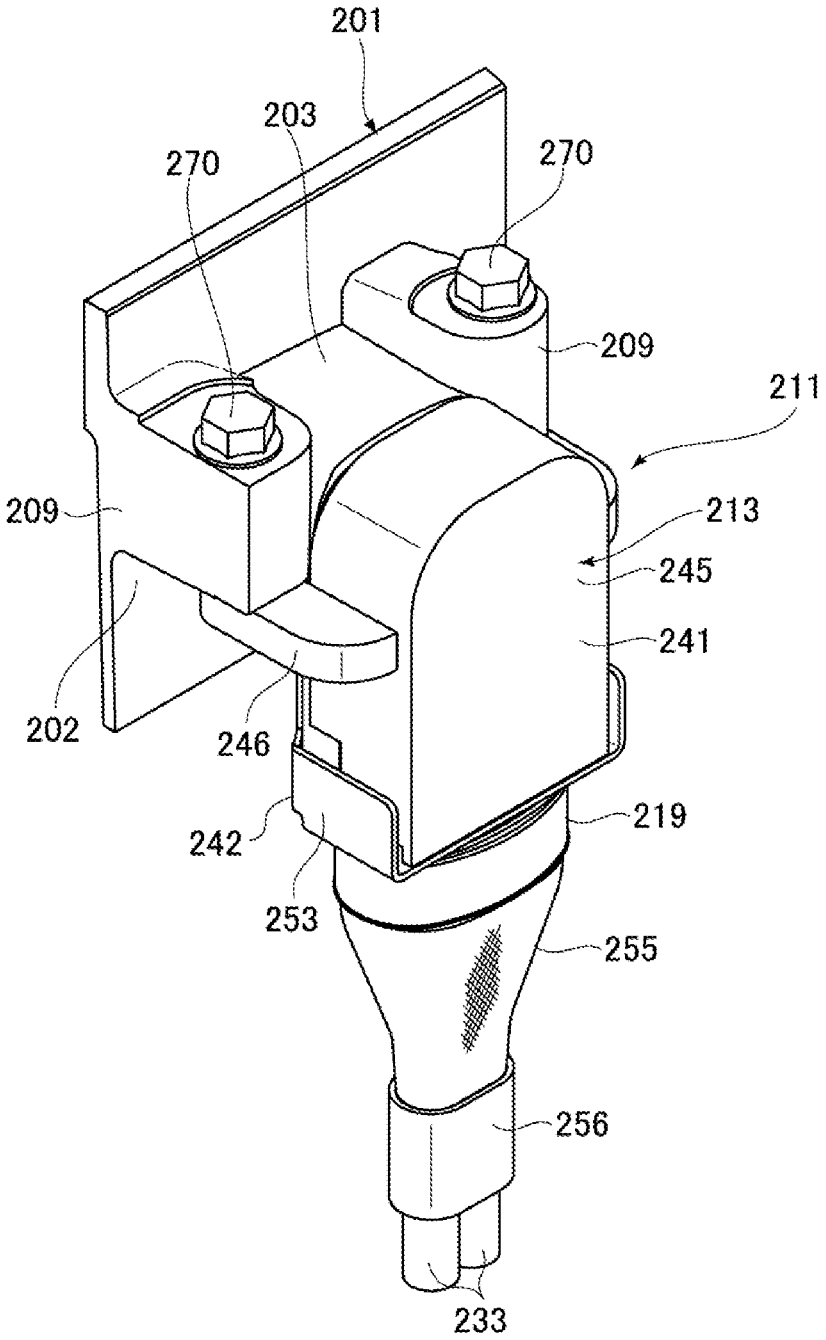
FIG. 6 is a perspective view showing a shield connector fixed to a shield case in order to explain a fixing structure of a shield connector according to a reference example.
Figure 7:
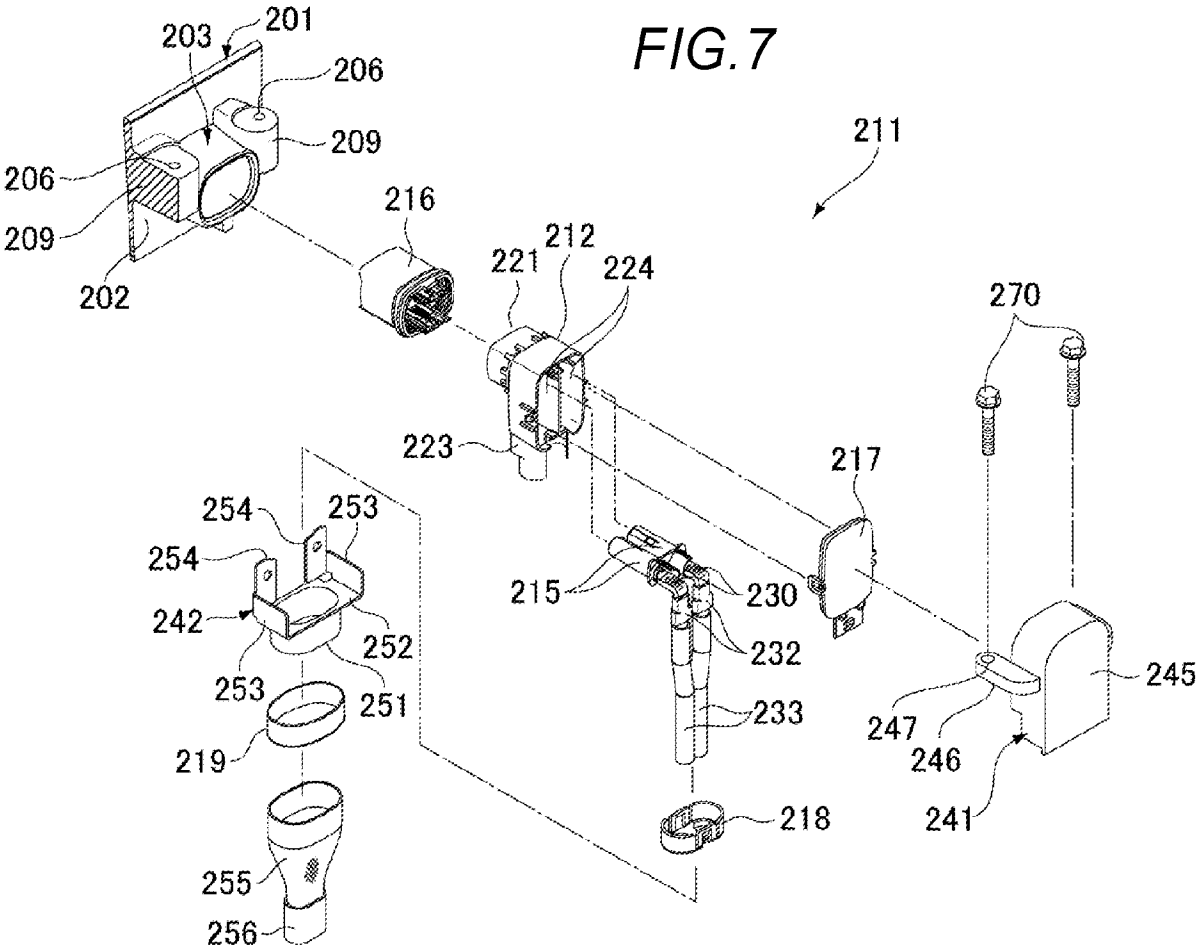
FIG. 7 is an exploded perspective view of the shield connector shown in FIG. 6.
Figure 8:
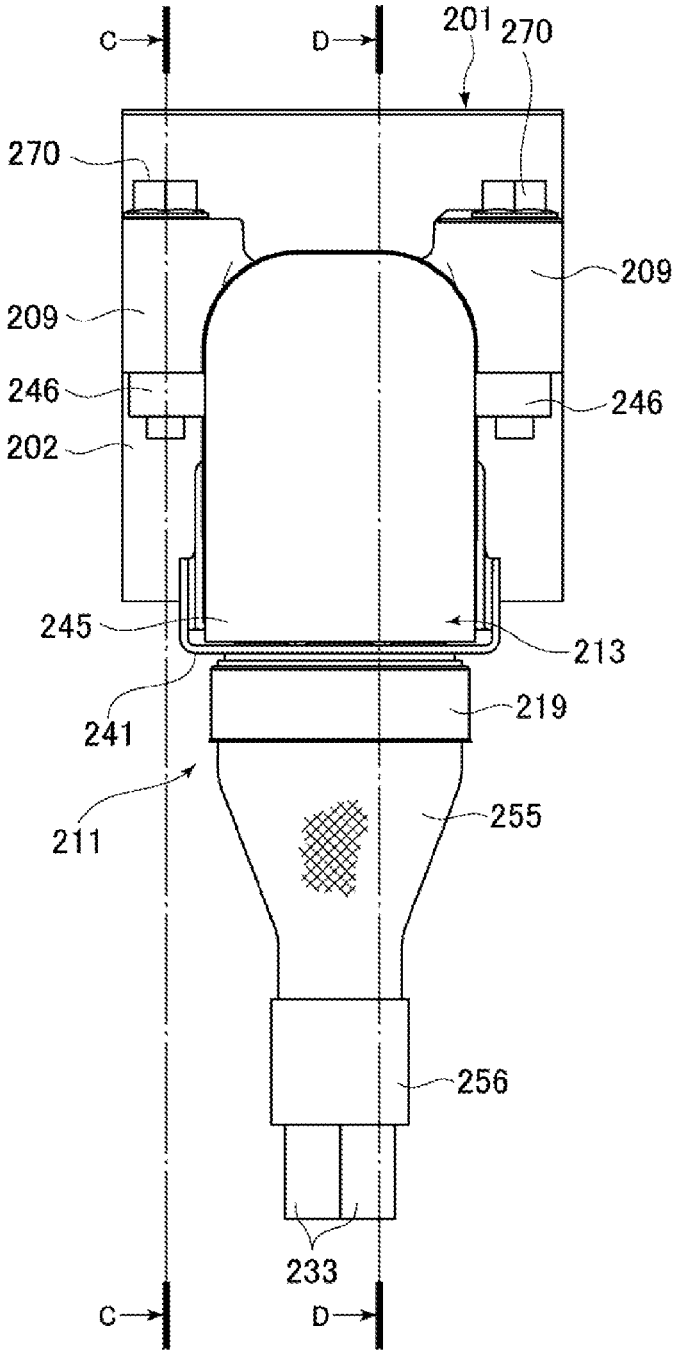
FIG. 8 is a rear view of the shield connector shown in FIG. 6.
Figure 9:
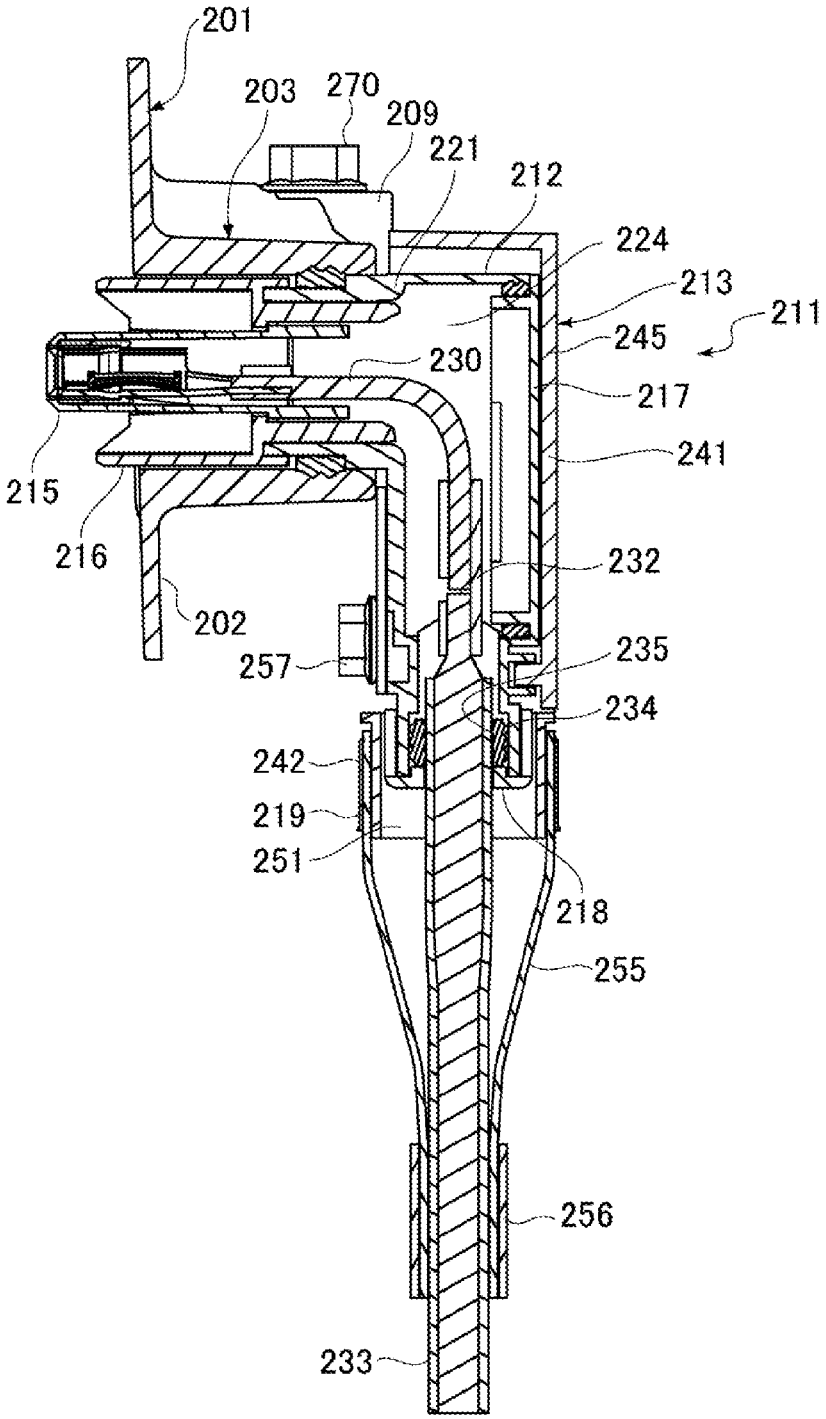
FIG. 9 is a sectional view taken along a line C-C in FIG. 8.
Figure 10:
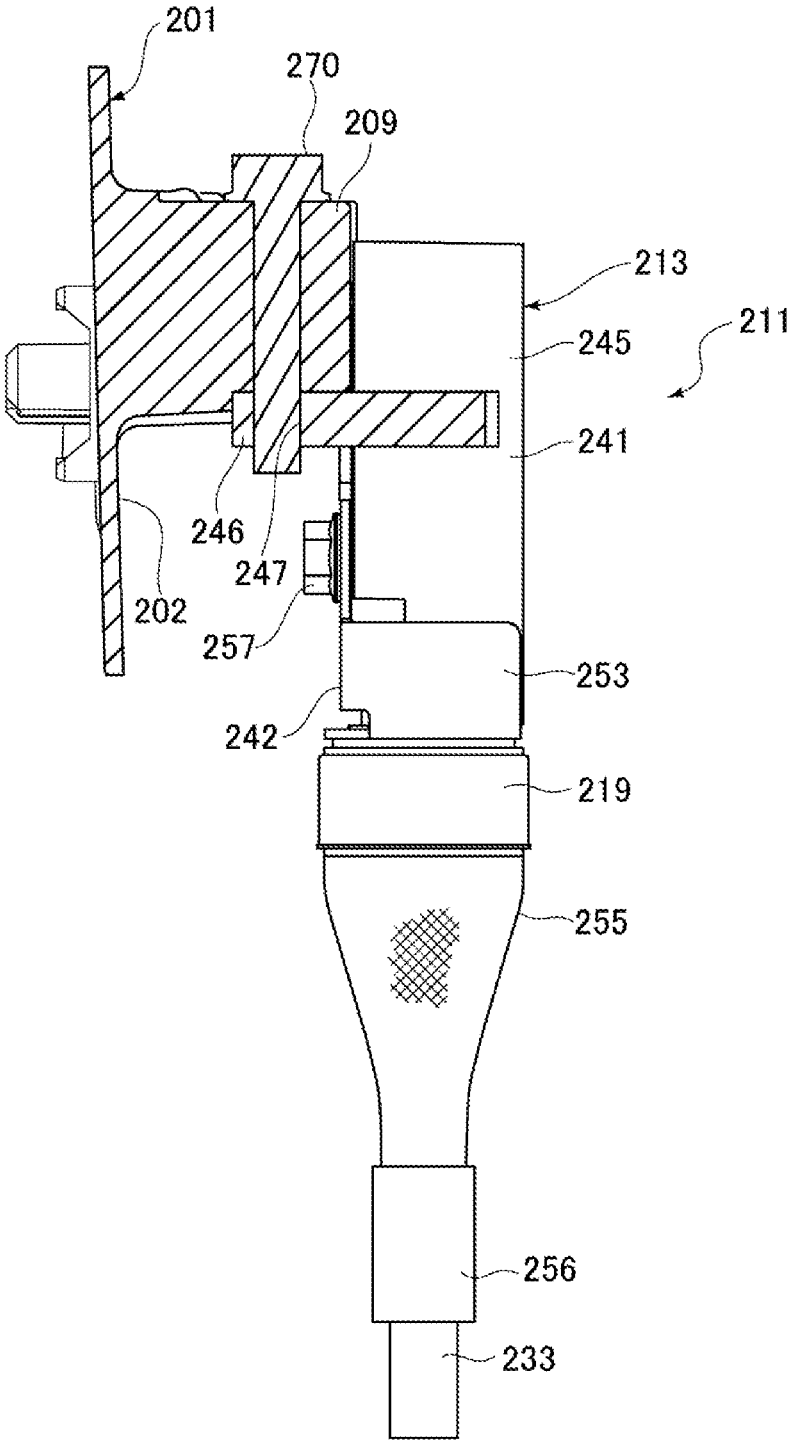
FIG. 10 is a sectional view taken along a line D-D in FIG. 8
Figure 11:
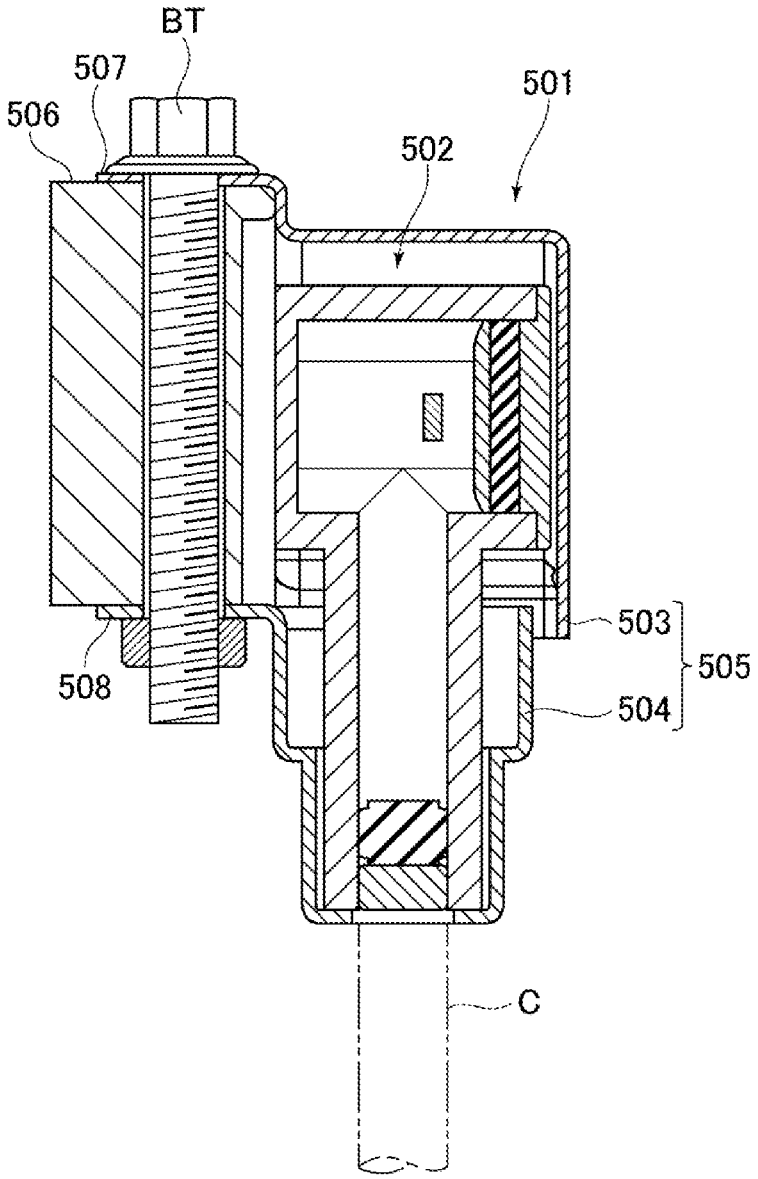
FIG. 11 is a sectional view of main parts showing a usual fixing structure of a shield connector.

FIG. 6 is a perspective view showing a shield connector fixed to a shield case in order to explain a fixing structure of a shield connector according to a reference example. FIG. 7 is an exploded perspective view of the shield connector shown in FIG. 6. FIG. 8 is a rear view of the shield connector shown in FIG. 6. FIG. 9 is a sectional view taken along a line C-C in FIG. 8. FIG. 10 is a sectional view taken along a line D-D in FIG. 8

As shown in FIG. 6, a fixing structure of a shield connector 211 according to a reference example is a fixing structure which fits and fixes a housing 212 of the shield connector 211 to a device side connector (an illustration is omitted) provided in a shield case 201.

As shown in FIG. 7 to FIG. 10, the shield connector 211 of the present reference example includes the housing 212 and a shield shell 213 as a main structure.

The shield case 201 is formed with an electrically conductive metal material, for instance, a metal case of an inverter or a motor mounted on an electric motor vehicle or a hybrid vehicle. Further, the shield case 201 may be a metal case of a PCU as an electric power control unit.

In the shield case 201, are provided a tubular fitting tube part 203 protruding on a connector attaching surface 202 and shield shell fixing parts 209 provided in both sides of the fitting tube part 203. The shield shell fixing parts 209 have bolt through holes 206 which pass through in a vertical direction.

The housing 212 according to the present reference example is formed with an insulating synthetic resin. The housing 212 has a fitting part 221 protruding in one end side thereof. To the fitting part 221, a front holder 216 is attached. Further, in the other end side of the housing 212, an electric wire leading-out part 223 is provided which is extended in a direction intersecting (downward in FIG. 7) a protruding direction of the fitting part 221. To the electric wire leading-out part 223, end parts of electric wires 233 to which terminals 232 are connected are guided. The electric wire 233 includes an electrically conductive core wire and an insulating coating part with which the core wire is coated. The core wire of the electric wire 233 is electrically connected to the terminal 232.

Further, in the housing 212, one pair of terminal accommodation chambers 224 are formed in a rear surface side thereof. The terminal accommodation chambers 224 are closed by a cover 217 attached from the rear surface of the housing 212. In the terminal accommodation chambers 224 respectively, connection terminals 215 are accommodated. The connection terminals 215 are connected to the terminals 232 through braided wires 230. Namely, since the terminals 232 of the electric wires 233 are connected to the connection terminals 215 through the flexible braided wires 230, a vibration of the electric wires 233 are absorbed by the braided wires 230, so that the vibration is hardly transmitted to the connection terminal 215 side.

As shown in FIG. 9, to a part near the end part of the electric wire 233, a rubber plug 234 is attached. The rubber plug 234 is fitted to the electric wire leading-out part 223. The rubber plug 234 is formed with an elastic material such as rubber. The rubber plug 234 has a hole part 235 and the electric wire 233 is inserted into the hole part 235. An outer periphery of the rubber plug 234 comes into close contact with an inner wall surface of the electric wire leading-out part 223 of the housing 212. Thus, the rubber plug 234 seals apart between the housing 212 and the electric wire 233 under a water-proofed state. Further, to the electric wire leading-out part 223 of the housing 212, a rear holder 218 is attached. The electric wire leading-out part 223 is closed by the rear holder 218. The rear holder 218 is attached to the electric wire leading-out part 223 of the housing 212, so that the electric wire 233 is restrained from being bent. Further, the rear holder 218 restrains the rubber plug 234 from slipping out or collapsing in the electric wire leading-out part 223.

The shield shell 213 according to the present reference example is formed with an electrically conductive metal material. The shield shell 213 includes an upper shell 241 and a lower shell 242. The upper shell 241 includes a housing accommodation part 245 and shell fixed parts 246 which are provided in both sides of the housing accommodation part 245. The housing accommodation part 245 is formed in the shape of a box which covers an upper surface, both side surfaces and a rear surface of the housing 212 and attached to the housing 212 from its rear surface side. The shell fixed parts 246 protrude in an attaching direction to the housing 212 and tapped holes 247 are formed in end parts thereof.

The lower shell 242 includes a tubular part 251, a plate shaped part 252 provided in one opening end side of the tubular part 251, side plate parts 253 vertically provided in both side ends of the plate shaped part 252 and end plate parts 254 respectively provided in one side edges of the side plate parts 253. The lower shell 242 is attached to the housing 212 from the electric wire leading-out part 223 side. The electric wire leading-out part 223 is fitted to the tubular part 251 and fixed by screws 257. In the lower shell 242, the tubular part 251 is covered with an end part of a braided wire 255 which covers peripheries of a plurality of electric wires 233 and a shield ring 219 is caulked on an outer peripheral side thereof. Thus, the braided wire 255 is electrically connected to the lower shell 242. On an outer periphery of the braided wire 255 which covers the electric wires 233, a coating 256 is provided.

When the upper shell 241 and the lower shell 242 are attached to the housing 212, the side plate parts 253 of the lower shell 242 abut on the side surfaces of the housing accommodation part 245 of the upper shell 241. Thus, the upper shell 241 is electrically conducted to the lower shell 242 to each other.

In order to connect the shield connector 211 according to the present reference example to the device side connector, the fitting part 221 provided with the front holder 216 in the housing 212 is allowed to come close to the shield case 201 side to fit the fitting part 221 to the fitting tube part 203 of the device side connector. Thus, in the shield connector 211, the connection terminals 215 thereof are electrically connected to connection terminals (an illustration is omitted) of the device side connector. Then, in a state that the fitting part 221 in the one end side of the housing 212 is fitted to the device side connector, the electric wires 233 led out from the electric wire leading-out part 223 in the other end side are led out in a lower direction intersecting the fitting direction to the device side connector.

Under this state, the shell fixed parts 246 of the upper shell 241 which forms the shield shell 213 are arranged under the shield shell fixing parts 209. The shell fixed parts 246 are arranged at positions where the tapped holes 247 face the bolt through holes 206 of the shield shell fixing parts 209.

Thus, fastening bolts 270 are inserted from an upper part to the bolt through holes 206, screwed and fastened to the tapped holes 247 of the shell fixed parts 246, so that the shell fixed parts 246 are fixed to lower ends of the shield shell fixing parts 209 by the fastening bolts 270 which pass through in a direction intersecting the fitting direction of the housing 212. Further, the shield shell 213 to which the braided wire 255 covering the electric wires 233 is electrically connected is electrically connected to the shield case 201. Thus, the shield shell 213 forms a shield circuit, so that a structure which shields noise is obtained.

As described above, in the shield shell 213 in the fixing structure of the shield connector 211 according to the present reference example, the shell fixed parts 246 are provided nearer to the electric wire leading-out part 223 side than an opposite side end (an upper end in FIG. 7) of the electric wire leading-out part 223. Accordingly, when the electric wires 233 led out from the housing 212 are bent or shaken, a bending moment applied to the shield connector 211 through the electric wire leading-out part 223 is more reduced and a stress applied to the shell fixed parts 246 is more decreased than those in the usual shield shell in which the shell fixed parts are provided in the opposite side end of the electric wire leading-out part.

Further, in the structure of the present reference example, since the shell fixed parts 246 are passed through and fastened by the fastening bolts 270 which pass through the shield shell fixing parts 209, although the fixed parts 246 are provided nearer to the electric wire leading-out part 223 side than the usual shield connector, a fastening height (a fastening operation position) of the fastening bolts 270 to the shield shell fixing parts 209 can be restrained from being greatly changed. Namely, when the shield shell 213 of the shield connector 211 is merely changed without changing a dimension of the shield case 201 side, the stress applied to the shell fixed parts 246 due to the vibration or bending of the electric wires 233 led out from the housing 212 can be reduced.

Accordingly, the fixing structure of the shield connector 211 which can improve a fixing strength of the shield shell 213 can be provided without increasing a cost.

Now, features of the fixing structure of the shield connector according to the reference example will be respectively briefly described below in the following [4] and [5].

[4] A fixing structure of a shield connector including:

a housing (212) in which an electric wire (233) is led out from one end side in a direction intersecting a fitting direction in a state that the other end side is fitted to a device side connector provided in a device, a shield shell (213) electrically connected and fixed to a shield case (201) of the device in a state that the housing (212) is covered with the shield shell (213), shield shell fixing parts (209) provided in the shield case (201), shell fixed parts (246) provided nearer to an electric wire leading-out part (223) side than an opposite side end of the electric wire leading-out part (223) in the shield shell (213) to fix the shield shell (213) to the shield shell fixing parts (209), and fastening bolts (270) which pass through and fasten the shield shell fixing parts (209) and the shell fixed parts (246) in a direction intersecting the fitting direction of the housing.

[5] A fixing structure of a shield connector according to the above-described [4], wherein the shell fixed parts 246 are passed through and fastened by the fastening bolts (270) passing through the shield shell fixing parts (209).

DESCRIPTION OF REFERENCE NUMERALS AND SIGNS

101: shield case
105: protector engaging part
109: shield shell fixing part
110: protector fixing part
111: shield connector
112: housing

113: shield shell
114: protector
123: electric wire leading-out part
133: electric wire
146: shell fixed part
163: protector fixed part
166: protector engaged part
170: fastening bolt

What is claimed is:

1. A fixing structure of a shield connector comprising:
a housing;
a shield shell;
a protector; and
a protector engaged part on an electric wire leading-out part side of the protector,
wherein in the housing, an electric wire is configured to be led out from one end side in a direction intersecting a fitting direction in a state that the other end side is fitted to a device side connector,
wherein the shield shell is configured to be electrically connected and fixed to a shield case of the device so as to cover the housing,
wherein the protector is attached to the electric wire leading-out part side in the shield shell so as to cover the electric wire led out from the housing,
wherein the protector engaged part is configured to be engaged with and disengaged from a protector engaging part on the shield case in the same direction as the fitting direction of the housing, and
wherein the protector covers the shield shell.

2. The fixing structure of a shield connector according to claim 1, further comprising:
a protector fixed part on a shield shell attaching part side on the protector,
wherein the protector fixed part is configured to fix the protector to a protector fixing part on the shield case.

3. The fixing structure of a shield connector according to claim 2, further comprising:
a shell fixed part on the shield shell; and
a fastening bolt,
wherein the shell fixed part is configured to fix the shield shell to a shield shell fixing parts on the shield case, and
wherein the fastening bolt is configured to pass through the shell fixed part, the shield shell fixing part, the protector fixing part, and the protector fixed part in a direction intersecting the fitting direction of the housing so as to fasten the shell fixed part, the shield shell fixing part, the protector fixing part, and the protector fixed part together.

4. The fixing structure of a shield connector according to claim 1,
wherein the protector engaging part comprises a bracket, extending longitudinally from the shield case in the fitting direction, connecting the protector engaging part and the protector engaged part via the bracket locking within a lock part of the protector engaged part.

5. The fixing structure of a shield connector according to claim 1,
wherein the direction, in which the electric wire is led out from the one end side, is substantially perpendicular to the fitting direction.

6. The fixing structure of a shield connector according to claim 1,
wherein protector fixed parts of the protector extend over a rear face and widthwise sides of the shield shell in the fitting direction and directly connect, via bolts extending through the protector fixed parts, to the shield case.

7. The fixing structure of a shield connector according to claim 6,
wherein the shield shell is also directly connected to the shield case via the bolts which also extend through attaching holes of the shield shell.

8. The fixing structure of a shield connector according to claim 7,
wherein the bolts extend in the direction in which the electric wire is led out from the one end side.

9. A fixing structure of a shield connector comprising:
a housing;
a shield shell;
a protector; and
a protector engaged part on an electric wire leading-out part side of the protector,
wherein in the housing, an electric wire is configured to be led out from one end side in a direction intersecting a fitting direction in a state that the other end side is fitted to a device side connector,
wherein the shield shell is configured to be electrically connected and fixed to a shield case of the device so as to cover the housing,
wherein the protector is attached to the electric wire leading-out part side in the shield shell so as to cover the electric wire led out from the housing,
wherein the protector engaged part is configured to be engaged with and disengaged from a protector engaging part on the shield case in the same direction as the fitting direction of the housing, and
wherein the fixing structure further comprises:
a protector fixed part on a shield shell attaching part side on the protector,
wherein the protector fixed part is configured to fix the protector to a protector fixing part on the shield case, and
wherein the fixing structure further comprises:
a shell fixed part on the shield shell; and
a fastening bolt,
wherein the shell fixed part is configured to fix the shield shell to a shield shell fixing parts on the shield case, and
wherein the fastening bolt is configured to pass through the shell fixed part, the shield shell fixing part, the protector fixing part, and the protector fixed part in a direction intersecting the fitting direction of the housing so as to fasten the shell fixed part, the shield shell fixing part, the protector fixing part, and the protector fixed part together.

* * * * *